United States Patent [19]

Andersen et al.

[11] 4,382,561

[45] May 10, 1983

[54] VERTICAL ROLLER MILL

[75] Inventors: Knud T. Andersen; Erik C. P. Christensen, both of Copenhagen, Denmark

[73] Assignee: F. L. Smidth & Co., Cresskill, N.J.

[21] Appl. No.: 231,262

[22] Filed: Feb. 3, 1981

[30] Foreign Application Priority Data

Feb. 18, 1980 [DK] Denmark ..... 690/80

[51] Int. Cl.[3] ..... B02C 15/00

[52] U.S. Cl. ..... 241/121; 241/290

[58] Field of Search ..... 241/103, 106, 117–122, 241/128, 290

[56] References Cited

U.S. PATENT DOCUMENTS

| | | | |
|---|---|---|---|
| 834,387 | 10/1906 | Little | 241/121 |
| 1,806,077 | 5/1931 | McMurray | 241/121 X |
| 3,782,646 | 1/1974 | Brundiek | 241/121 |
| 4,127,237 | 11/1978 | Mehta et al. | 241/121 X |
| 4,218,023 | 8/1980 | Brundiek | 241/121 |

FOREIGN PATENT DOCUMENTS 3258 of 1915 United Kingdom .

*Primary Examiner*—Mark Rosenbaum
*Attorney, Agent, or Firm*—Pennie & Edmonds

[57] ABSTRACT

A vertical roller mill includes a grinding table positioned for rotation around a vertical axis and two upright grinding rollers resting on their peripheral grinding surfaces on the grinding table for grinding material thereon. Each of the grinding rollers is rotatably mounted on a respective fixed horizontal shaft connected at one end to a common, central frame and at the other end to a draw bar. Preferably, the draw bar is regulated by a hydraulic cylinder secured in a bracket which is anchored in the mill foundation.

12 Claims, 4 Drawing Figures

VERTICAL ROLLER MILL

TECHNICAL FIELD

This invention relates to a roller mill and particularly to a vertical roller mill wherein the grinding rollers rotate around stationary generally horizontally mounted shafts.

BACKGROUND ART

In known vertical roller mills having a grinding table capable of rotating around a vertical axis, the grinding rollers are suspended in a pressure frame positioned above the rollers. The frame urges the rollers against the grinding table by means of draw bars which are connected to the pressure frame itself.

The construction of the roller suspension in the pressure frame of the known mill is comparatively complicated and thereby vulnerable. Furthermore, such construction makes it difficult to replace worn or defective rollers. We have invented a vertical roller mill which remedies the drawbacks of known vertical roller mill constructions.

DISCLOSURE OF THE INVENTION

The present invention relates to a roller mill comprising a grinding table adapted for rotation about a vertical axis, at least two grinding rollers, at least two stationary generally horizontally mounted roller shafts, each grinding roller being adapted for rotation on a respective shaft, means for pressing the grinding rollers against the grinding table, a centrally positioned frame, the roller shafts being secured to the frame at their ends adjacent the vertical axis and the pressing means being pivotally coupled to the other ends of the roller shafts.

In one preferred embodiment, the present invention relates to a vertical roller mill comprising a horizontal grinding table adapted for rotation about a central vertical axis and at least two upright grinding rollers positioned with their peripheral grinding surfaces in engagement with the grinding table for grinding material thereon. Each grinding roller is positioned for rotation on a respective horizontal roller shaft. A draw bar is associated with each roller shaft. Each draw bar is anchored at one end to the mill foundation and is pivotally connected at the other end to the outer end of the respective roller shaft. Each draw bar also has means for urging the respective rollers against the horizontal grinding table. A frame, centrally positioned in relation to the grinding table, is connected to the inner end of the associated roller shafts.

Preferably, the roller shafts are removably secured to the central frame. According to one preferred embodiment, the vertical roller mill further comprises first flanges positioned on the central frame and corresponding second flanges positioned on the inner end of each roller shaft, the first and second flanges adapted for engagement for securing the roller shafts to the central frame. Alternatively, the central frame is composed of a plurality of members clamped together and around the inner ends of the roller shafts. In yet another alternative embodiment, the roller shafts are clamped in the central frame by adjustable, conical rings.

The vertical roller mill according to the present invention further comprises means for restraining the roller shafts from moving in the direction of rotation of the grinding table. Preferably, the restraining means are generally horizontal draw bars coupled to the outer ends of the roller shafts.

The vertical roller mill according to a second preferred embodiment of the present invention has at least four grinding rollers comprising two frames centrally positioned one above the other. Each frame is common to two of the grinding rollers. Alternatively, the vertical roller mill has at least six grinding rollers comprising two frames centrally positioned one above the other. Each frame is common to three of the grinding rollers.

As compared with known roller mills, the mill according to the present invention is distinguished in that the roller suspension consists of few, uncomplicated and rather robust parts. Such construction makes possible comparatively easy replacement of the rollers, partly by the achievement of improved control of the rollers and reduced dynamic loads on the roller suspension.

Such replacement of the rollers is further facilitated if the shafts are removably secured to the common, central frame.

BRIEF DESCRIPTION OF THE DRAWINGS

The present invention is described in greater detail below in reference to the drawings wherein.

DESCRIPTION OF THE BEST MODE OF THE INVENTION

Figure 1:
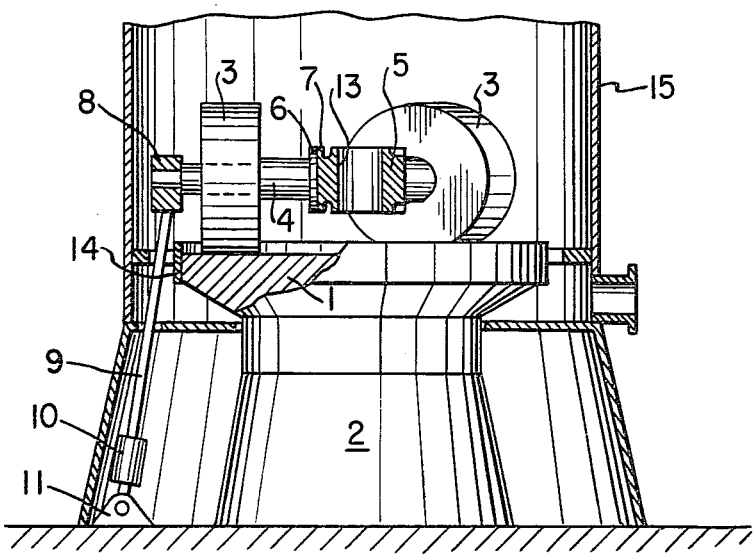
FIG. 1 is a partly diagrammatic, partially cut-away, side elevational view of a roller mill according to the present invention.

Referring to the FIGS., a grinding table 1 is illustrated in FIG. 1 for rotating around a vertical axis and is supported and driven by a unit 2. The preferred embodiment shown in FIG. 2 includes three grinding rollers 3 resting and rolling on the grinding table 1. The three grinding rollers 3 grind a material layer (not shown) on the grinding table 1. Each grinding roller 3 is pivotally mounted on a fixed shaft 4 which together with the shafts of the other grinding rollers 3 are secured to a common, central frame 5.

The shafts 4 can be secured in various ways to the frame 5, e.g., by a flange 6 as shown in the drawings on each shaft 4 and similar flanges 7 on the frame 5.

The frame 5 can also be composed of several parts which can be clamped together and around the inner ends of the shafts 4. Alternatively, the shafts 4 can be shunk in corresponding holes in the frame 5 or may be secured on the frame 5 by adjustable conical rings. Furthermore, the frame 5 and the shafts 4 can be cast in one single part.

A bracket 8 is pivotally mounted at the outer end of each shaft 4. A draw bar 9, secured to the bracket 8, ensures that the respective grinding roller 3 is urged against the grinding table 1 by means of a hydraulic cylinder 10 which is pivotally retained in a bracket 11 anchored in the mill foundation. The cylinder 10, alternatively, can be replaced by a system of springs.

Figure 2:
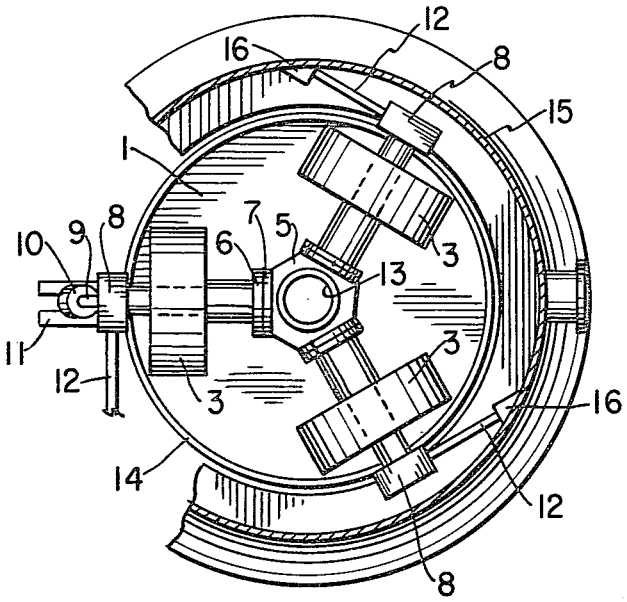
FIG. 2 is a top view of the roller mill of FIG. 1.

To ensure that the shafts 4 do not move in the direction of rotation of the grinding table 1, they are retained in position, e.g., by horizontal draw or tension bars 12 as shown in the preferred embodiment of FIG. 2. The tension bars 12 are secured at one end to the brackets 8 and at the other end, e.g., to the mill housing 15 by brackets 16 as shown in FIG. 2. Furthermore, typical means (not shown) are positioned in the wall of the mill housing 15 at the outer end of the shafts 4 whereby undesired movements of the shafts 4 in the radial direction of the grinding table 1 are avoided.

Material which is to be ground can be fed into the gaps between the rollers 3. In a preferred embodiment, material is fed centrally on the grinding table 1 through an opening 13 in the middle of the frame 5 or possibly as an overflow between the interconnecting parts of the frame 5. A dam ring 14 determines the grinding layer thickness on the grinding table 1.

The present invention, which is not limited to the preferred embodiment shown in the FIGS., is also directed to mills having a set of only two rollers, mills having rwo or more sets each consisting of two rollers or mills having two or more sets each consisting of three rollers. In the latter example, the mill comprises several frames 5 positioned axially above each other, each frame carrying one of the roller sets. Thus, a mill may have four or six rollers with two frames 5 positioned above each other, each carrying every second roller.

Figure 3:
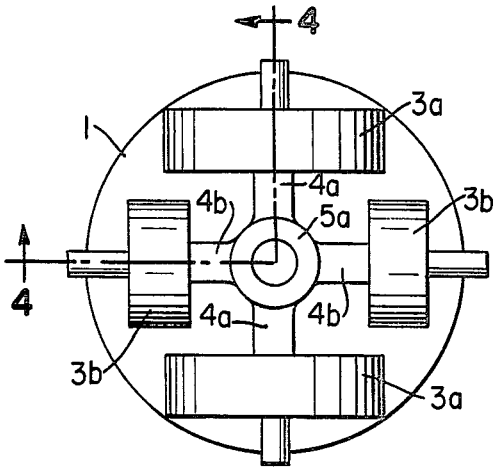
FIG. 3 is a top view of an alternative embodiment of the roller mill of FIG. 1.
Figure 4:
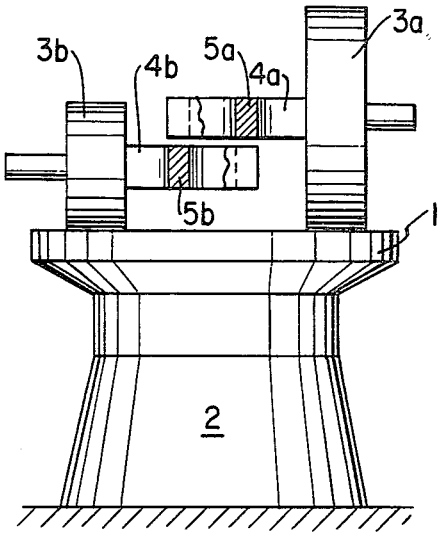
FIG. 4 is a side elevational view taken along the line 4—4 of FIG. 3.

As illustrated in FIGS. 3 and 4, the mill in one alternative embodiment includes two frames 5*a* and 5*b* which have respective shafts 4*a* and 4*b* formed integrally therewith to accommodate two pairs of grinding rollers 3*a* and 3*b*. As shown in FIG. 4, frame 5*a* is positioned above 5*b* wherefore the respective grinding rollers 3*a* are larger in diameter than grinding rollers 3*b*.

We claim:

1. A roller mill comprising a grinding table adapted for rotation about a vertical axis, at least two grinding rollers, at least two stationary generally horizontally mounted roller shafts each having an inner end portion positioned adjacent the vertical axis and an outer end portion, each grinding roller being adapted for rotation on a respective shaft, means for pressing the grinding rollers against the grinding table, a frame positioned centrally of the grinding table, said roller shafts being secured to said frame at their inner end portions and said pressing means being pivotally coupled to the outer end portions of the roller shafts.

2. A vertical roller mill having a mill foundation comprising a grinding table adapted for rotation about a vertical axis, at least two grinding rollers positioned in engagement with said grinding table, at least two stationary generally horizontally mounted roller shafts each having an inner end portion positioned adjacent the vertical axis and an outer end portion, each grinding roller being adapted for rotation on a respective shaft, means anchored in the mill foundation for pressing the grinding rollers against the grinding table, a frame positioned centrally of the grinding table, said roller shafts being secured to said frame at their inner end portions and said pressing means being pivotally coupled to the outer end portions of the roller shafts.

3. Vertical roller mill having a mill foundation, a grinding table which rotates around a vertical axis and at least two grinding rollers rotating around stationary generally horizontally mounted shafts each having an inner end facing the mill axis and an outer end, the rollers being urged against the grinding table by means of draw bars anchored in the mill foundation, characterized in that all the roller shafts at their inner ends are secured to a common frame centrally positioned in relation to said grinding table, the draw bars being pivotally connected to the outer ends of said respective shafts.

4. The vertical roller mill according to claim 3, characterized in that the roller shafts are removably secured to said central frame.

5. The vertical roller mill according to claim 4, further comprising first flanges positioned on said central frame and corresponding second flanges positioned on the inner end of each roller shaft, said first and second flanges adapted for engagement for securing the roller shafts to said central frame.

6. The vertical roller mill according to claim 4, characterized in that said central frame is composed of a plurality of members clamped together and around the inner ends of the roller shafts.

7. The vertical roller mill according to claim 4, characterized in that the roller shafts are clamped in said central frame by adjustable, conical rings.

8. The vertical roller mill according to claim 4, further comprising means for retaining the roller shafts in position from moving in the direction of rotation of the grinding table.

9. The vertical roller mill according to claim 8 wherein said restraining means are generally horizontal draw bars coupled to the outer ends of the roller shafts.

10. The vertical roller mill according to any one of claims 3–9 having at least four grinding rollers comprising two frames centrally positioned one above the other, each frame being common to two of said grinding rollers.

11. The vertical roller mill according to any one of claims 3–9 having at least six grinding rollers comprising two frames centrally positioned one above the other, each frame being common to three of said grinding rollers.

12. A vertical roller mill comprising a horizontal grinding table adapted for rotation about a central vertical axis, at least two upright grinding rollers positioned with their peripheral grinding surfaces in engagement with said grinding table for grinding material thereon, each grinding roller being positioned for rotation on a respective horizontal roller shaft having an inner end and an outer end, a draw bar associated with each roller shaft, each draw bar being anchored at one end to the mill foundation and being pivotably connected at the other end to the outer end of the respective roller shaft, each draw bar having means for urging the respective rollers against said horizontal grinding table, a frame centrally positioned in relation to said grinding table, said frame being connected to the inner ends of said associated roller shafts.

* * * * *